US007827953B2

(12) United States Patent
Roerig et al.

(10) Patent No.: US 7,827,953 B2
(45) Date of Patent: Nov. 9, 2010

(54) SWITCHABLE SUPPORT ELEMENT FOR A VALVE TRAIN OF AN INTERNAL COMBUSTION ENGINE

(75) Inventors: Bodo Roerig, Weisendorf (DE); Joachim Seitz, Reundorf (DE); Matthew Evans, Warren, MI (US); Robert Heinemann, Herzogenaurach (DE); Tracy Novinski, Macomb Township, MI (US)

(73) Assignee: Schaeffler KG, Herzogenaurach (DE)

( * ) Notice: Subject to any disclaimer, the term of this patent is extended or adjusted under 35 U.S.C. 154(b) by 309 days.

(21) Appl. No.: 12/169,125

(22) Filed: Jul. 8, 2008

(65) Prior Publication Data

US 2009/0013943 A1 Jan. 15, 2009

Related U.S. Application Data

(60) Provisional application No. 60/948,619, filed on Jul. 9, 2007.

(51) Int. Cl.
*F01L 1/14* (2006.01)

(52) U.S. Cl. ..... 123/90.48; 123/90.52; 74/569

(58) Field of Classification Search ..... 123/90.48, 123/90.52, 90.55; 74/567, 569
See application file for complete search history.

(56) References Cited

U.S. PATENT DOCUMENTS 7,246,587 B2 * 7/2007 Evans et al. ..... 123/90.52

* cited by examiner

*Primary Examiner*—Ching Chang
(74) *Attorney, Agent, or Firm*—Lucas & Mercanti, LLP

(57) ABSTRACT

The invention proposes a switchable support element (1) for a valve train of an internal combustion engine, said support element comprising a housing (2) in whose bore (3) an axially displaceable inner element (4) is received, a coupling means (6) extending in the inner element (4) can be brought partially into engagement with an entraining surface (7) of the housing (2) for achieving coupling, and said support element (1) further comprising at least one vertical stop means (10) that overlaps an annular groove (9) between the inner element (4) and the housing (2) for defining a coupling position of said coupling means (6) with coupling lash relative to said entraining surface (7), the vertical stop means (10) is constituted by at least one thin-walled ring comprising a slot (11), the ring is placed or slipped, slot (11) ahead, onto an outer peripheral surface (12) of the housing (2) to extend parallel to a transverse plane of the support element (1), the housing (2) comprises at least one aperture (13) through which an inner peripheral segment (14) of the ring extends, a longitudinal groove (16) extends in the outer peripheral surface (15) of the inner element (4), and an underside (18) of the inner peripheral segment (14) comes to abut against a lower end (17) of said groove for defining the coupling position.

9 Claims, 3 Drawing Sheets

SWITCHABLE SUPPORT ELEMENT FOR A VALVE TRAIN OF AN INTERNAL COMBUSTION ENGINE

FIELD OF THE INVENTION

The invention concerns a switchable support element for a valve train of an internal combustion engine, said support element comprising a housing in whose bore an axially displaceable inner element comprising a head for mounting a finger lever is received, a coupling means extending in the inner element can be brought partially into engagement with an entraining surface of the housing for achieving coupling [axially distant position of the inner element relative to the housing], a lost motion spring means being arranged for acting between the inner element and the housing, and said support element further comprising at least one vertical stop means that overlaps an annular groove between the inner element and the housing for defining a coupling position of said coupling means with coupling lash relative to said entraining surface.

BACKGROUND OF THE INVENTION

Support elements of the pre-cited type are well known in the technical field. The vertical stop means is constituted, for example, by transversely extending pins that are fixed in a reception of one of the components (housing or inner element) and project into a corresponding groove on the respective other component. For instance, these pins are pressed into said reception. To a person skilled in the art, it is clear that this interference can come loose during the operation of the valve train. In addition, pressing-in introduces an undesired force into the surrounding material. Further, the pins cannot be removed if disassembly is required (selective pairing of thickness-grouped pins for adjusting coupling lash . . . ).

In other solutions known from older prior art, a bore-distal front end of the housing comprises a radially inward bent-over collar against which the inner element abuts through a respective counter surface. This collar proves to be relatively complex from the manufacturing point of view, especially because it likewise does not enable an appropriate adjustment of a coupling lash.

In still other prior art solutions, the vertical stop means is constituted by one or two locking rings/snap rings that extend in a groove of one of the components and, in case of abutment, function as a stop in cooperation with a corresponding edge of the respective other component. It is noted in this connection that handling of these snap rings is relatively difficult in practice.

OBJECT OF THE INVENTION

The object of the invention is therefore to provide a switchable support element of the pre-cited type in which the aforesaid drawbacks are eliminated.

SUMMARY OF THE INVENTION

This object is achieved according to the invention by the fact that the vertical stop means is constituted by at least one thin-walled ring comprising a slot, the ring is placed or slipped axially, slot ahead, onto an outer peripheral surface of the housing to extend parallel a transverse plane of the support element, the housing comprises at least one aperture through which a corresponding inner peripheral segment of the ring extends, a longitudinal or annular grove extends in the outer peripheral surface of the inner element, into which groove the inner peripheral segment projects, and an underside of the inner peripheral segment comes to abut against a lower end of said groove for defining the coupling position.

In this way, a switchable support element is obtained in which the aforesaid drawbacks are effectively eliminated in a simple manner. The thin-walled, U-shaped ring constituting the vertical stop means is available, for example, as an extremely cheap mass article.

After pre-assembly of the switchable support element, the ring can be slipped onto the outer peripheral surface of the housing in a simple manner, with the slot ahead, preferably but not exclusively in parallel orientation to a transverse plane of the support element. According to a further development of the invention, for its axial fixing, the ring can be made to extend in a corresponding annular groove in the outer peripheral surface of the housing.

According to another provision of the invention, the outer peripheral surface of the housing comprises at least one slot (but preferably, two slots situated diametrically opposite each other), into which slot the ring, as a vertical stop means, projects with a respective inner peripheral segment. Thus, this inner peripheral segment extends radially inwards partially beyond the bore of the housing.

As a counter surface for the inner peripheral segment of the ring, a flattened longitudinal groove is arranged, for instance, on the corresponding inner peripheral segment-side of the outer peripheral surface of the inner element. An important feature of the invention is that a lower end of the longitudinal groove of the inner element serves as a stop surface for an underside of the inner peripheral segment for defining the coupling position.

Using off-the-shelf rings sorted in height groups as vertical stops, the coupling lash can be adjusted in a manner, known per se. By coupling lash (whose variation should be kept as constantly low as possible over a large series of elements) is to be understood the idle displacement of the inner element with extended coupling elements towards the housing into the stop position of the inner element on the ring when the coupling element comes to abut against the respective entraining surface of the housing.

The aforesaid ring constituting the vertical stop means may be made of spring steel or the like. However, it is also conceivable to configure it out of a light weight material like plastic.

According to a particularly advantageous development of the invention, the ring constituting the vertical stop acts at the same time as an anti-rotation device between the inner element and the housing. For this purpose, an inner peripheral surface of the inner peripheral segment of the ring can be configured as a chord-shaped key surface that directly adjoins the longitudinal groove in the inner element configured as a complementary, longitudinal flattened portion. It is clear to a person skilled in the art that preferably two opposing key surfaces will be used, but their number may also differ from this.

According to another provision of the invention, an upper end of the longitudinal or annular groove in the outer peripheral surface of the inner element is configured as a stop surface for defining a retracted position of the inner element. In this way, it can be avoided, for instance, that the lost motion spring (preferably a coiled compression spring or a coiled compression spring assembly) reaches it block position.

It is emphasized that the aforesaid measures like upper vertical stop, lower vertical stop and anti-rotation device may also be provided singly or in combination with only one of the other measures.

The aperture or apertures in the outer periphery of the housing can be generated, for example, with the help of a simple disk milling cutter.

Finally, according to another feature of the invention, the coupling means is at least one piston that extends in a radial bore of the inner element and can be displaced for achieving coupling into or under the entraining surface. Preferably, two coupling pistons situated diametrically opposite each other in the inner element are used. A coupling surface in the housing can be constituted, for example, by an annular groove, an annular groove segment, an aperture, an underside of a projection etc.

BRIEF DESCRIPTION OF THE DRAWING

The invention is described more closely in the following with reference to the appended drawing.

DETAILED DESCRIPTION OF THE DRAWING

Figure 1:
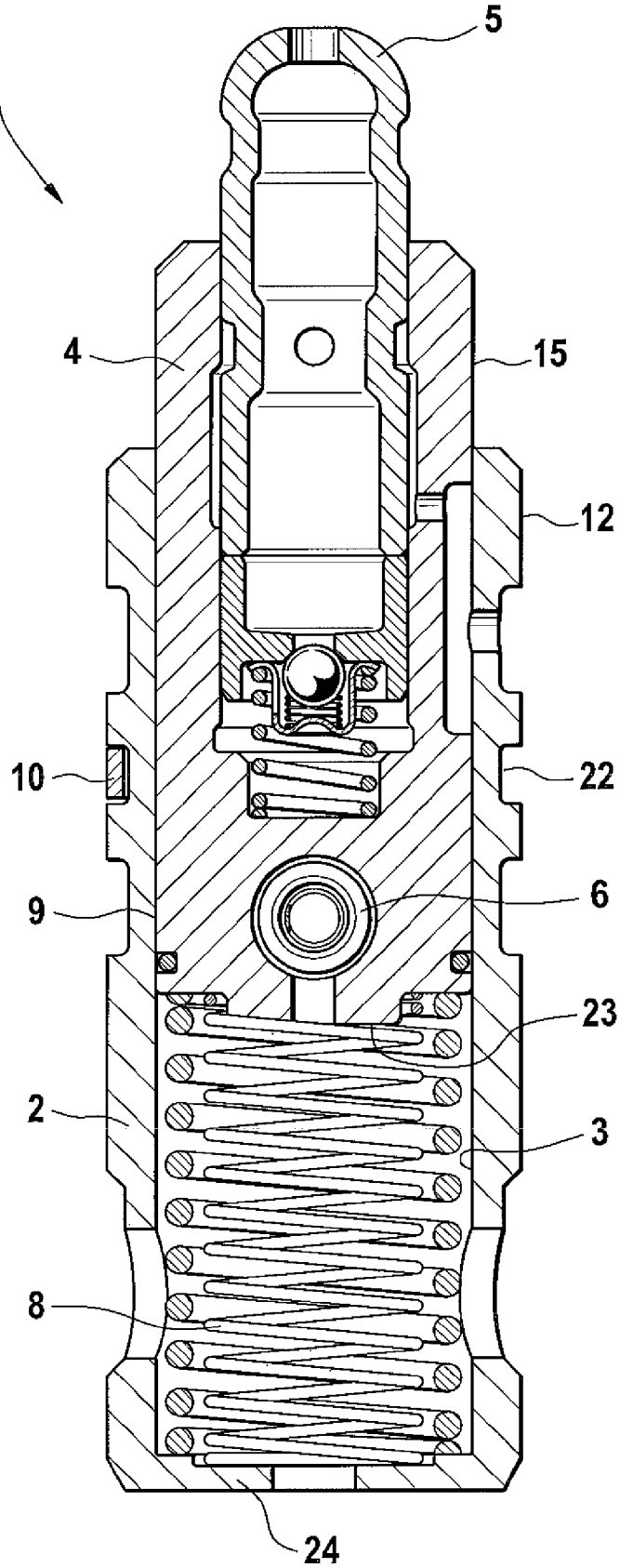
FIGS. 1, 2 each show longitudinal sections through the support element of the invention, offset by 90° from one another.
Figure 2:
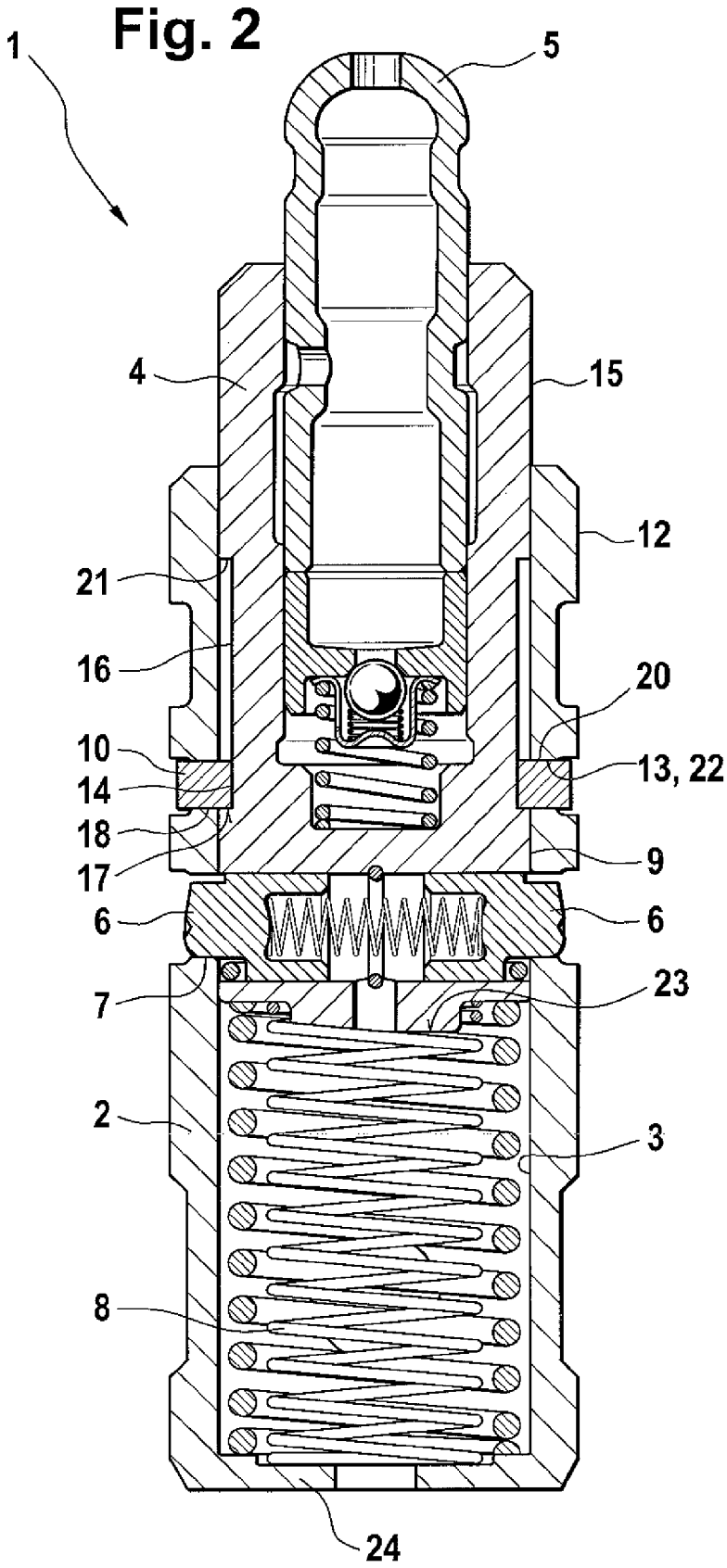
Figure 3:
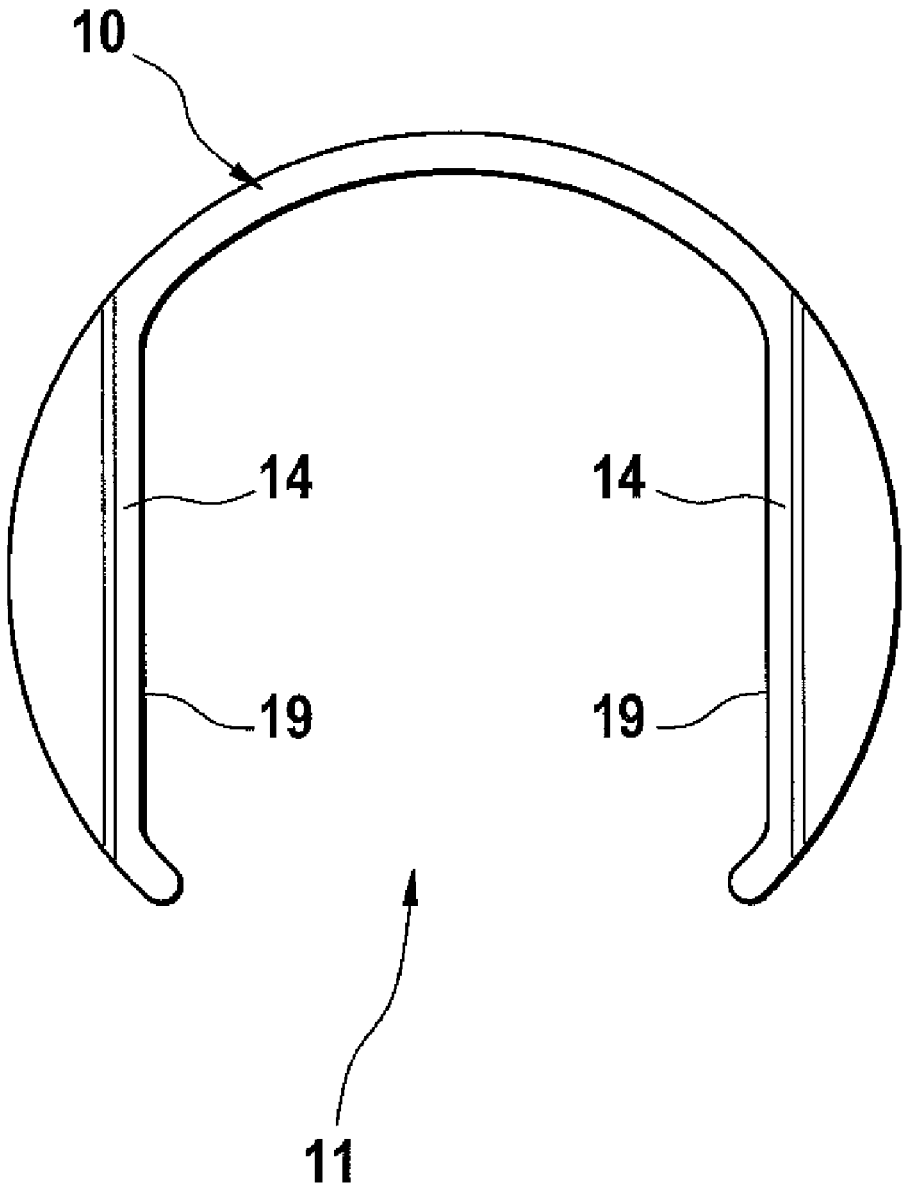
FIG. 3 shows a ring constituting a vertical stop means.

FIGS. 1 and 2 disclose a switchable support element 1. This support element 1 comprises a pot-shaped housing 2 that is closed by a bottom 24. An inner element 4 extends within a bore 3 of the housing for axial displacement relative to the housing 2. The inner element 4 comprises a hydraulic lash adjuster, not needing specific description here, and a head 5 of the inner element projects out of the housing 2. A lost motion spring means 8 (coiled compression spring assembly) is installed between an underside 23 of the inner element 4 and the bottom 24.

Directly above its underside 23, the inner element 4 comprises a coupling means (6) in the form of two pistons situated diametrically opposite each other in a bore. These pistons can be displaced radially outwards by compression spring force into their coupling position illustrated in FIG. 2. In the coupled state, these pistons project into a corresponding aperture serving as an entraining surface 7 in the housing 2.

As best seen in FIG. 2, a thin-walled ring comprising a slot 11 and forming a vertical stop means 10 is arranged in an annular groove 22 in the outer peripheral surface 12 of the housing 2. For assembly, this ring is "slipped-on" in parallel orientation to a transverse plane of the support element 1. Two diametrically opposed inner peripheral segments 14 of said ring project through corresponding apertures 13 of the housing 2 so as to extend radially inside, for example, in a longitudinal groove 16 in the outer peripheral surface 15 of the inner element 4, so that they are seated with their inner peripheral surface 19, configured as a chord-shaped key surface, directly in front of the respective longitudinal groove 16 of the inner element 4.

FIG. 2 illustrates the end stop state of the inner element 4 with the lower end 17 of the longitudinal groove 16 bearing against an underside 18 of the inner peripheral segment 14 of the ring. Thus a coupled position, not needing further specification, with coupling lash of the coupling means 6 relative to the entraining surface 7 in the housing 2 is created.

At the same time, a simple anti-rotation device of the inner element 4 relative to the housing 2 is obtained through the aforesaid chord-like key surfaces of the inner peripheral surface 19 of the inner peripheral segments 14 of the ring that cooperate with the longitudinal groove 16 of the inner element 4, so that the coupling means 6 is oriented in peripheral direction with respect to its entraining surface 7. If the entraining surface 7 is configured as an annular groove, this anti-rotation device may be omitted, if appropriate.

Further, an upper end 21 of the longitudinal or annular groove 16 in the outer peripheral surface 15 of the inner element 4 can be used to define a retracted position of the inner element in the housing 2. To define the retracted position, the upper end 21 of the longitudinal or annular groove 16 of the inner element 4 comes to abut against an upper side 20 of the inner peripheral segment 14 of the ring constituting the vertical stop means 10 (for uncoupling). This prevents a block position of the lost motion spring 8.

During assembly, the outer peripheral surface of the ring constituting the vertical stop means 10 can, but does not have to, project beyond the outer peripheral surface 12 of the housing 2.

REFERENCE NUMERALS

1 Support element
2 Housing
3 Bore
4 Inner element
5 Head
6 Coupling means
7 Entraining surface
8 Spring means
9 Annular gap
10 Vertical stop means
11 Slot
12 Outer peripheral surface
13 Aperture
14 Inner peripheral segment
15 Outer peripheral surface
16 Longitudinal or annular groove
17 Lower end
18 Underside
19 Inner peripheral surface
20 Upper side
21 Uppers
22 Annular groove
23 Underside
24 Bottom

The invention claimed is:

1. A switchable support element for a valve train of an internal combustion engine, said support element comprising:

a housing having a bore, an axially displaceable inner element comprising a head for mounting a finger lever in the bore, a coupling means extending from the inner element which can be brought partially into engagement with an entraining surface of the housing for achieving coupling, at an axially distant position, of the inner element relative to the housing, a lost motion spring means arranged for acting between the inner element and the housing, at least one vertical stop means that overlaps an annular groove between the inner element and the housing for defining a coupling position of said coupling means with coupling lash relative to said entraining surface, wherein the vertical stop means is at least one thin-walled ring comprising a slot, the ring is placed or slipped axially, slot ahead, onto an outer peripheral surface of the housing to extend parallel to a transverse plane of the support element, the housing comprises at least one aperture through which a corresponding inner peripheral segment of the ring extends, a longitudinal or annular groove extends in the outer peripheral surface of the inner element, into which longitudinal or annular groove the corresponding inner peripheral segment projects, and an underside of the inner peripheral segment comes to abut against a lower end of the said longitudinal or annular groove for defining the coupling position.

2. The support element according to claim 1, wherein the vertical stop means also constitutes an anti-rotation means of the inner element relative to the housing.

3. The support element according to claim 2, wherein:

the longitudinal groove in the outer peripheral surface of the inner element for forming the anti-rotation means, an inner peripheral surface of the inner peripheral segment of the ring is configured as a chord-shaped key surface that directly adjoins the longitudinal groove of the inner element, which groove is configured as a flattening of complementary shape to said key surface.

4. The support element according to claim 1, wherein through an abutment of an upper side of the inner peripheral segment of the ring constituting the vertical stop means against an upper end of the longitudinal or annular groove in the outer peripheral surface of the inner element, a retracted position of the inner element in an uncoupled state is defined, so that the lost motion spring means is situated outside of a block position.

5. The support element according to claim 1, wherein the ring constituting the vertical stop means is fixed in an annular groove in the outer peripheral surface of the housing.

6. The support element according to claim 1, the housing comprises exactly two apertures that are arranged diametrically opposite each other, into which apertures the ring constituting the vertical stop means engages with exactly two respective inner peripheral segments.

7. The support element according to claim 1, wherein the ring constituting the vertical stop means has a U-like configuration.

8. The support element according to claim 1, wherein the lost motion spring means is one of a compression spring, a coiled compression spring or an assembly of said springs that is supported at one end on an underside of the inner element and at another end, on a bottom of the housing.

9. The support element according to claim 1, wherein the coupling means is at least one piston that extends in a radial bore of the inner element and can be displaced into or under the entraining surface of the housing for coupling.

* * * * *